US012691361B2

(12) United States Patent
Berglund et al.

(10) Patent No.: US 12,691,361 B2
(45) Date of Patent: Jul. 28, 2026

(54) PADEL COURT CONSTRUCTION

(71) Applicant: Instantpadel in Sweden AB, Vendelsö (SE)

(72) Inventors: Magnus Berglund, Vendelsö (SE); Christoffer Granfelt, Lidingö (SE)

(73) Assignee: Instantpadel in Sweden AB, Vendelsö (SE)

( * ) Notice: Subject to any disclaimer, the term of this patent is extended or adjusted under 35 U.S.C. 154(b) by 539 days.

(21) Appl. No.: 18/038,072

(22) PCT Filed: Jul. 18, 2021

(86) PCT No.: PCT/SE2021/050701

§ 371 (c)(1),
(2) Date: May 22, 2023

(87) PCT Pub. No.: WO2022/115014

PCT Pub. Date: Jun. 2, 2022

(65) Prior Publication Data

US 2023/0405444 A1 Dec. 21, 2023

(30) Foreign Application Priority Data

Nov. 25, 2020 (SE) ..... 2051373-5

(51) Int. Cl.

| | |
|---|---|
| ***A63C 19/00*** | (2006.01) |
| ***A63C 19/06*** | (2006.01) |
| *A63B 102/08* | (2015.01) |

(52) U.S. Cl.

CPC ..... *A63C 19/06* (2013.01); *A63B 2102/08* (2015.10)

(58) Field of Classification Search

CPC ... A63C 19/06; A63C 19/08; A63C 2019/085; A63B 61/00; A63B 2102/08;

(Continued)

(56) References Cited

U.S. PATENT DOCUMENTS 3,745,729 A * 7/1973 Vaughn ..... E04H 17/16 52/750
3,758,106 A * 9/1973 Liebig ..... A63B 71/022 473/465

(Continued)

FOREIGN PATENT DOCUMENTS

CN 107050834 A * 8/2017 ..... A63B 71/0036
CN 107137913 A * 9/2017 ..... E01C 13/065

(Continued)

OTHER PUBLICATIONS

International Search Report and Written Opinion mailed Aug. 25, 2021; International Patent Application No. PCT/SE2021/050701 filed on Jul. 8, 2021. ISA/SE.

*Primary Examiner* — Kiley S Stoner
(74) *Attorney, Agent, or Firm* — McDonald Hopkins LLC

(57) ABSTRACT

The invention relates to a padel court construction for playing padel, the padel court construction comprising a padel field; at least two panels configured to at least partly enclose the padel field; and at least one strut configured to connect the at least two panels to each other. The padel court construction further comprising a ground profile configured to guide the at least two panels in relation to each other, and an adjustment element configured to displace at least one of the panels in relation to the ground profile.

9 Claims, 11 Drawing Sheets

(58) Field of Classification Search
CPC ..... A63B 2210/50; A63B 2225/11; A63B 2225/74; A63B 71/022; A63B 71/02–028; A63B 2102/02–38
USPC ..... 473/459, 467, 490, 524–557
See application file for complete search history.

(56) References Cited

U.S. PATENT DOCUMENTS

| | | | | | |
|---|---|---|---|---|---|
| 3,951,406 | A | | 4/1976 | Rock | |
| 4,014,521 | A | * | 3/1977 | Berman | E04H 17/00 473/494 |
| 4,102,101 | A | * | 7/1978 | Nielsen | A63C 19/00 52/308 |
| 4,167,839 | A | * | 9/1979 | Nielsen | A63B 71/022 52/261 |
| 4,192,503 | A | * | 3/1980 | Karas | A63B 71/022 473/459 |
| 4,834,377 | A | * | 5/1989 | Weiss | A63B 47/025 473/459 |
| 6,394,918 | B1 | | 5/2002 | Erhard | |
| 2001/0018387 | A1 | * | 8/2001 | Webber | A63B 21/078 482/145 |
| 2004/0180736 | A1 | * | 9/2004 | Majumdar | A63B 69/0002 473/454 |
| 2010/0087268 | A1 | * | 4/2010 | Liao | A63B 69/3621 473/259 |
| 2017/0043229 | A1 | * | 2/2017 | Ohanyan | A63B 71/00 |
| 2018/0290042 | A1 | * | 10/2018 | Vester | A63B 71/023 |
| 2020/0224840 | A1 | * | 7/2020 | Papineau | F21S 8/081 |
| 2021/0008432 | A1 | * | 1/2021 | Ward | A63B 61/003 |

FOREIGN PATENT DOCUMENTS

| | | | | | |
|---|---|---|---|---|---|
| CN | 211058394 | U | * | 7/2020 | A63C 19/08 |
| DE | 3712618 | A | * | 11/1988 | |
| DE | 19932815 | A1 | | 1/2001 | |
| DE | 202017104858 | U1 | * | 10/2017 | A63C 19/08 |
| ES | 1070784 | | | 10/2009 | |
| ES | 1129405 | U | | 10/2014 | |
| FR | 2555062 | A | * | 5/1985 | |
| FR | 3033352 | A | | 9/2016 | |
| FR | 3033352 | A1 | * | 9/2016 | A63C 19/08 |
| GB | 2332376 | A | * | 6/1999 | E04H 17/08 |
| GB | 2579573 | A | * | 7/2020 | A63C 19/02 |
| IT | 201900005162 | | | 10/2020 | |
| WO | WO-2014124213 | A1 | * | 8/2014 | A63B 71/02 |
| WO | WO-2020076232 | A1 | * | 4/2020 | E01C 13/08 |
| WO | WO-2020202053 | A1 | * | 10/2020 | E01C 13/04 |
| WO | WO-2021094958 | A1 | * | 5/2021 | E04H 3/10 |
| WO | WO-2021156691 | A1 | * | 8/2021 | A63C 19/08 |
| WO | WO-2022058985 | A1 | * | 3/2022 | A63C 19/02 |

* cited by examiner

PADEL COURT CONSTRUCTION

CROSS-REFERENCE TO RELATED APPLICATION

This application is a 35 U.S.C. 371 national stage filing of PCT Application No. PCT/SE2021/050701, filed on Jul. 8, 2021, which claims the benefit of Swedish Patent Application No. 2051373-5, filed on Nov. 25, 2020, both of which are incorporated herein in their entirety by reference.

TECHNICAL FIELD

The present disclosure relates to a padel court construction for playing padel.

BACKGROUND ART

Padel is a racket sport, which is played on a padel field, enclosed or partly enclosed by walls made of transparent plastic glass panels and metal fence panels. The padel field is divided in half by a net. The padel court construction comprises the padel field, the walls and the net.

Padel is played in double, wherein two players in the same team plays against two players from another team. A ball is played over the net and is allowed to bounce on the padel field and on the walls. It is also possible to play padel in single.

The International Padel Federation (IPF) is the governing body of the padel sport. The IPF stipulates the rules of playing padel and the dimensions of the padel court. Further, the IPF approve rackets and balls for official padel competitions.

There are known padel court constructions, which are arranged as mobile facilities, and thus may be movable to different locations. This may be suitable for an installation of the padel court on an event, i.e. for a limited duration. Document FR3033352A1 discloses a padel court construction, which may be dismantled at one location and be mounted in another location.

SUMMARY OF THE INVENTION

The known padel court constructions, which are adapted to be movable to different locations are however bulky when dismantled and therefore takes up unnecessarily large space for transportation. Further, the known padel court constructions, which are adapted to be movable to different locations are not adapted for unevenness in the ground, which results in time consuming mounting of the padel court construction. In addition, the known padel court constructions, which are adapted to be movable to different locations comprises a large number of components, which results in time consuming dismantling and mounting of the padel court construction.

There is thus a need for an improved padel court construction, which is compact when dismantled and takes up a small space for transportation. There is also a need to develop an improved padel court construction, which is adapted for unevenness in the ground. There is also a need to develop an improved padel court construction, which comprises a small number of components.

An objective of the invention is thus to provide an improved padel court construction, which is compact when dismantled and takes up a small space for transportation. A further objective is to develop an improved padel court construction, which is adapted for unevenness in the ground.

A further objective is to develop an improved padel court construction, which comprises a small number of components.

These objectives are achieved by a padel court construction according to the appended claims.

According to an aspect of the invention, a padel court construction for playing padel is provided. The padel court construction comprising: a padel field; at least two panels configured to at least partly enclose the padel field; and at least one strut configured to connect the at least two panels to each other, wherein the padel court construction further comprising: a ground profile configured to guide the at least two panels in relation to each other; and an adjustment element configured to displace at least one of the panels in relation to the ground profile.

Such padel court construction is compact when dismantled and takes up a small space for transportation. Thus, a cost effective and an environmentally friendly transportation on trucks or trains may be achieved. Further, the padel court construction is adapted for unevenness in the ground. Thus, the demands of evenness of the ground surface on the location where the padel court construction is to be mounted may be low. In addition, the padel court construction comprises a small number of components. Thus, the time for dismantling and mounting of the padel court construction may be reduced. The unique design of the padel court construction results in a flexibility of mounting padel padel court constructions having different sizes. Due to the flexibility of dismantling and mounting of the padel court construction, the sport of padel may be available for more people.

Further objects, advantages and novel features of the present invention will become apparent to one skilled in the art from the following details, and also by putting the invention into practice. Whereas embodiments of the invention are described below, it should be noted that it is not restricted to the specific details described. Specialists having access to the teachings herein will recognise further applications, modifications and incorporations within other fields, which are within the scope of the invention.

BRIEF DESCRIPTION OF THE DRAWINGS

For fuller understanding of the present disclosure and further objects and advantages of it, the detailed description set out below should be read together with the accompanying drawings, in which the same reference notations denote similar items in the various figures, and in which.

DETAILED DESCRIPTION

Figure 1:
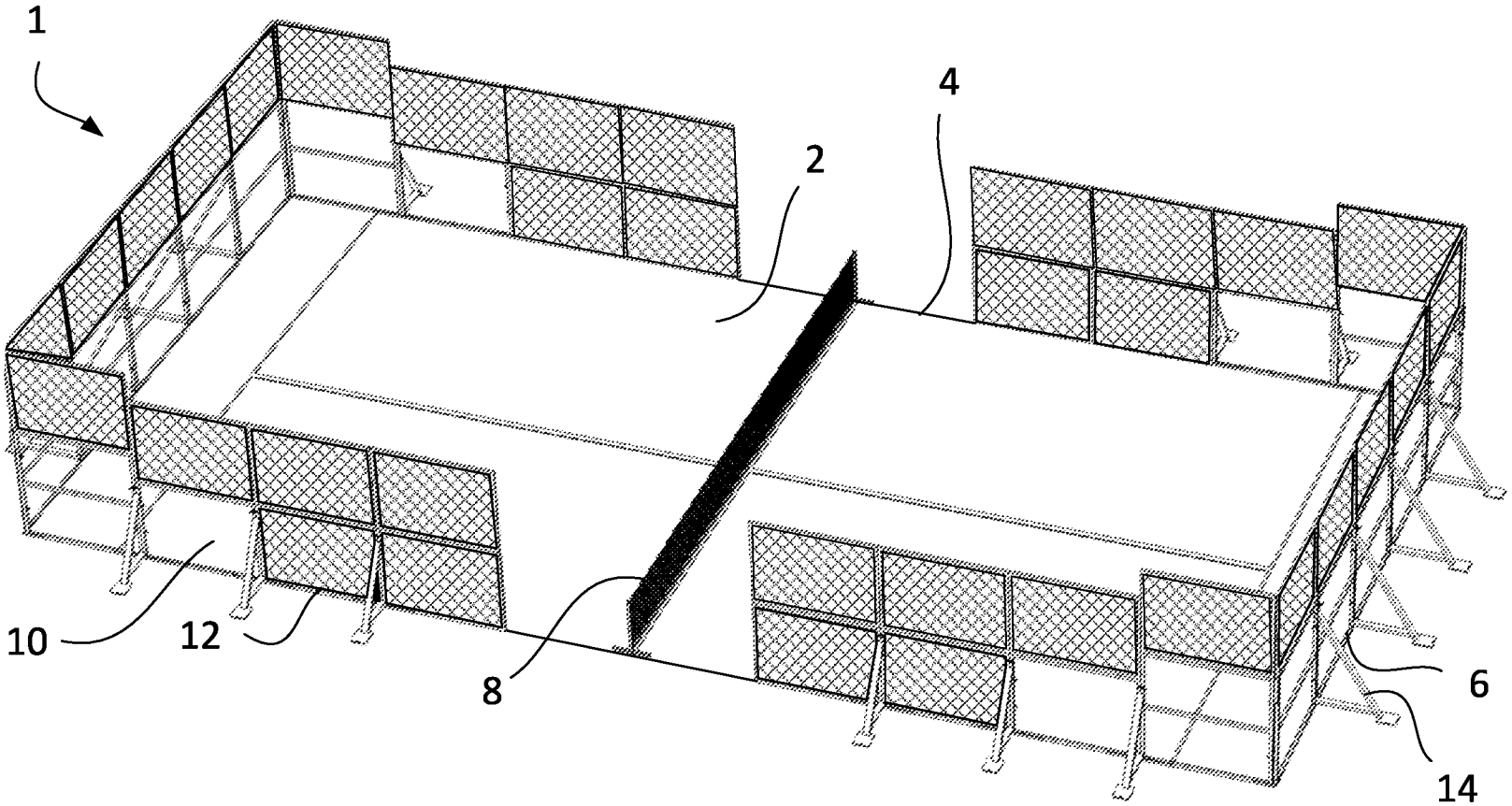
FIG. 1 illustrates a schematic view in perspective of a padel court construction according to an example.

The detailed description with reference to the examples depicted are to be viewed as examples comprising a combination of certain features, which features have been described in detail above. It is thus to be understood that additional examples may be achieved by combining other features into examples not depicted herein. The figures are to be viewed as examples and not mutually exclusive combinations. It should also be noted that all figures shown and described are schematically represented, wherein generic parts of machinery or similar is not depicted for the sake of simplicity.

According to an aspect of the present disclosure, a padel court construction for playing padel is provided. The padel court construction comprising a padel field; at least two panels configured to at least partly enclose the padel field; and at least one strut configured to connect the at least two panels to each other. The padel court construction further comprising a ground profile configured to guide the at least two panels in relation to each other, and an adjustment element configured to displace at least one of the panels in relation to the ground profile.

The padel court construction comprises the padel field, which is configured to rest on the ground. The padel field may comprise a number of flat field parts, which are connectable to each other. The field parts may be provided with colour and lines, so when the parts are connected to each other, they form a padel field with the colour and lines, which are stipulated in the rules of padel. The field parts may be connected to each other by suitable connecting means. Alternatively, the padel field may be folded and unfolded when dismantling and mounting the padel court construction. A further alternative is to roll up and roll out the padel field, when dismantling and mounting the padel court construction. The padel field has two long sides and two short sides.

The panels may comprise a frame on which a transparent glass panel, an opaque panel or a fence is attached. The panels may be made of glass, plastic, wood and/or concrete. A number of panels may be connected to each other to form a wall, which enclose or partly enclose the padel field. The connected panels are configured to extend along the two long sides and two short sides of the padel field. The panels connected to each other may be a combination of panels having similar or different sizes. The panels connected to each other may be a combination of panels having different materials, such as transparent glass, opaque material or a fence. The panels may be connected to each other by connectors, comprising at least two latches. The padel court construction may be provided with a roof connected to the panels.

The strut may comprise an elongated beam, which is configured to extend in an angle in relation to the panels and the ground. The strut is configured to be connected to two panels. The strut is configured to connected two panels to each other. The strut is configured to be connected to a ground plate. In one end of the elongated beam, the strut is connected to the panels. The strut may comprise a connection element in the end, which is connected to the panels. The connection element may be configured to connect the two panels to each other.

The connection element may be a clamp, which is configured to be connected to the frame of the panels. In the other end of the elongated beam, the strut is connected to the ground plate. The ground plate is configured to rest on the ground. The strut is configured to support and hold up the panels in a vertical direction. The ground plate, the frame of the panels and the ground profile may be provided with a protective cover, such as rubber, on that said which abut against the ground surface. The protective cover may protect the ground surface. When mounting the padel court construction indoors, a floor surface may be protected from wear by means of the protective cover. Due to the configuration of the components of the padel court construction, the padel court construction may be dismantled and mounted by hand, without need of tools.

The ground profile is configured to rest on the ground. The ground profile may guide and align the panels. The alignment of the panels results in a flush surface directed towards the padel field. The flush surface formed by the panels facilitates the padel game when the padel ball bounces against the wall.

The adjustment element is configured to affect the panel to be displaced in relation to the ground profile. Even though the adjustment element displaces the panel, the panel is guided by the ground profile. The ground profile is configured to guide the panel during the displacement movement accomplished by the adjustment element.

According to an aspect, the adjustment element is a threaded bolt arranged in a threaded bore in the at least one panel. The threaded bore may be arranged in the frame of the panel. By turning the threaded bolt, the panel is displaced in relation to the ground profile.

According to an aspect, the adjustment element is configured to abut against a surface of the ground profile, so that a displacement of the at least one panel in relation to the ground profile is achieved by rotation of the adjustment element. An end surface of the adjustment element may abut against the ground profile. The adjustment element displaces the panel in relation to the ground profile when the adjustment element is rotated.

According to an aspect, the ground profile is a U-beam comprising two flanges connected by a web arranged in a U-profile. An outer surface of the web of the U-beam is configured to rest on the ground. The U-beam is elongated and is configured to guide at least two panels.

According to an aspect, the at least two panels are configured to be arranged within the U-profile of the U-beam and resting on the inner surface of the web of the U-beam. The panels are guided by the inner surface of the web of the U-beam. The panels are guided by the inner surface of the respective flanges of the U-beam. The adjustment element is configured to abut the inner surface of the web of the U-beam, so that a displacement of the at least one panel in relation to the U-beam is achieved by rotation of the adjustment element.

According to an aspect, the at least one strut comprises a crossbar, which is configured to connect the at least two panels to each other.

The crossbar is configured to extend in an angle in relation to the elongated beam of the strut. The crossbar is configured to be connected to two panels. The crossbar is configured to connected two panels to each other. The crossbar is configured to be connected to the elongated beam. In one end of the crossbar, the crossbar is connected to the panels. The crossbar may comprise a connection element in the end, which is connected to the panels. The connection element may be configured to connect the two panels to each other. The connection element may be a clamp, which is configured to be connected to the frame of the panels. In the other end of the crossbar, the crossbar is connected to the elongated beam of the strut. The connection between the crossbar and the elongated beam of the strut may be a hinge, so that the crossbar is foldable in relation to the elongated beam of the strut, when the strut is disconnected from the panels. The hinge provides for a compact storage of the struts when the padel court construction is dismantled and should be transported.

According to an aspect, the strut and panels together are configured as a framework. The elongated beam of the strut, the crossbar and the panels to which the elongated beam and the crossbar are connected form a framework. The framework is configured to resist large forces and to stabilize the padel court construction.

According to an aspect, the at least one strut is extendable by means of a telescopic arrangement. Due to unevenness in the ground surface, the elongated beam may be extended or shortened by means of the telescopic arrangement.

According to an aspect, a fence is configured to be connected to at least one of the panels by rods, which are adapted to be introduced in openings arranged in the top of the at least one panel. The openings may be arranged in the frame of the panels. The rods may be fixated in the openings by means of fastening elements. However, the rods may extend into the frame of the panels and by the gravity the fence may secured in relation to the panels. Such a connection may be easy to assemble and disassemble.

According to an aspect, the at least two panels are configured to be connected to a further panel at a corner of the padel field, and wherein a further ground profile is configured to guide the further panel in relation to one of the at least two panels; and wherein the further panel is configured to be displaceable in relation to the further ground profile. The further panel may be connected to one of the connected panels by means of loops arranged on sides of the respective panels. The loops are connected by means of a pin. The loops and the pin are configured as a catch, locking the panels to each other in order to form a corner. The corner panels are configured to be arranged at a corner of the padel field. The further ground profile is a corner profile configured to extend in orthogonal directions. The further ground profile may be a U-beam extending in orthogonal directions. The U-beam comprising two flanges connected by a web arranged in a U-profile. An outer surface of the web of the U-beam is configured to rest on the ground. Further adjustment elements may be configured to abut the inner surface of the web of the U-beam, so that a displacement of the further panel in relation to the U-beam is achieved by rotation of the adjustment element.

The present invention will now be further illustrated with reference to the appended figures.

FIG. 1 illustrates a schematic view in perspective of a padel court construction 1 according to an example. The padel court construction 1 comprises a padel field 2. The padel field 2 is divided in half by a net 8. The padel field 2 has two long sides 4 and two short sides 6. Panels 10 are at least partly enclosing the padel field 2. The connected panels 10 form a wall 12. Struts 14 are configured to connect the panels 10 to each other.

Figure 2B:
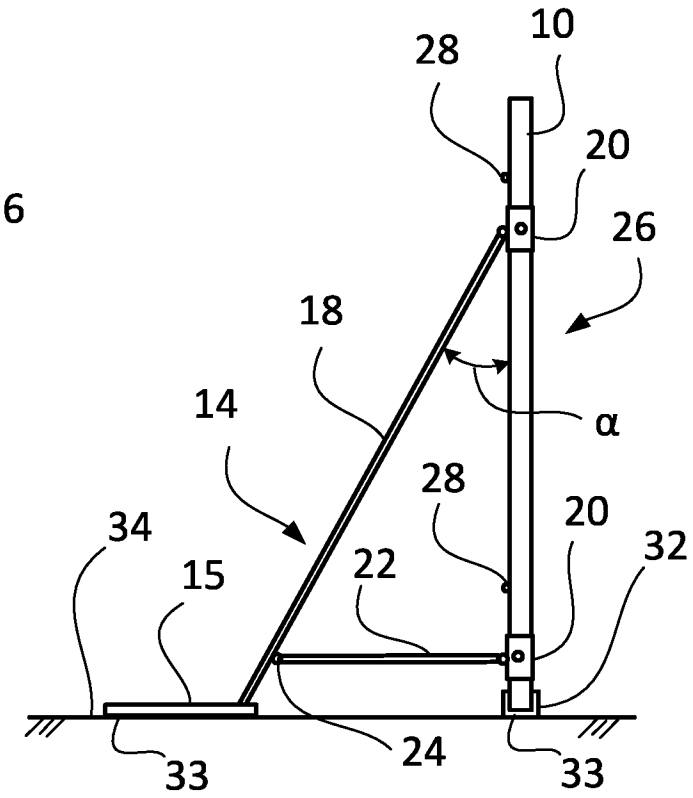
FIGS. 2*a* and 2*b* illustrate a schematic front view and side view of panels connected by a strut according to an example.
Figure 2A:
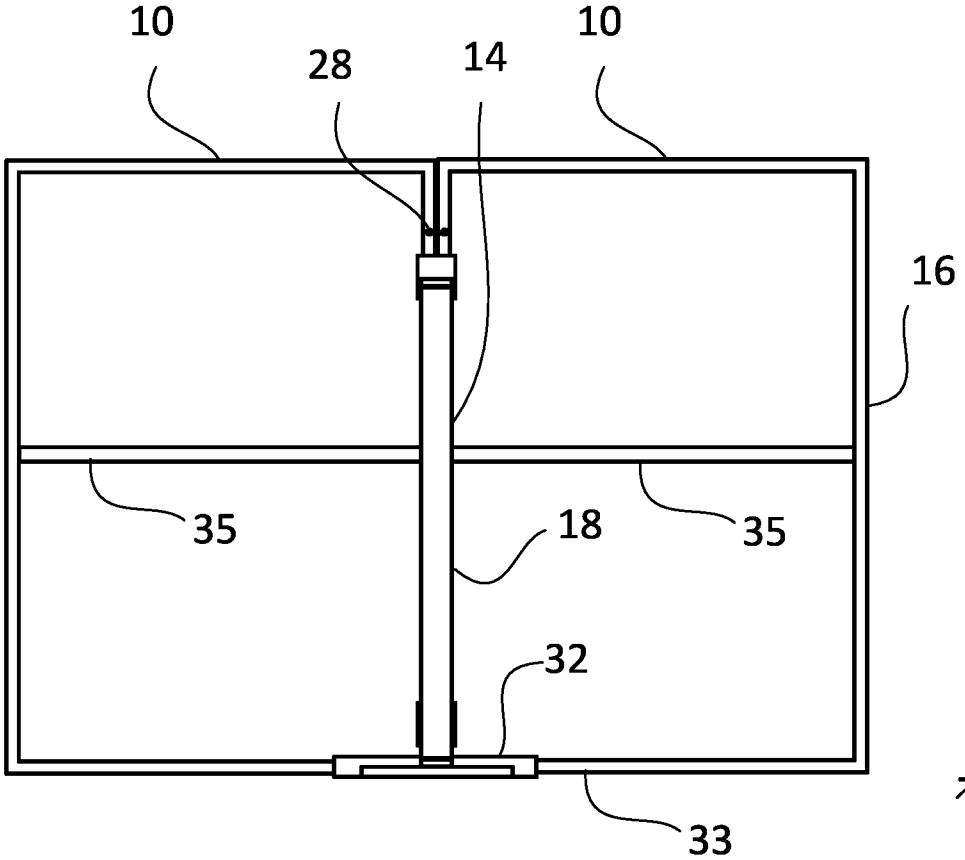

FIGS. 2*a* and 2*b* illustrate a schematic front view and side view of panels 10 connected by a strut 14 according to an example. Each panel 10 comprises a frame 16. The strut 14 comprises an elongated beam 18, which extends in an angle $\alpha$ in relation to the panels 10 and the ground surface 34. The strut 14 comprises a connection element 20 in the end, which is connected to the panels 10. The strut 14 is connected to a ground plate 15, which rests on the ground surface 34. The strut 14 comprises a crossbar 22, which is configured to connect the at least two panels 10 to each other. The crossbar 22 comprises a connection element 20, which is connected to the panels 10. The connection between the crossbar 22 and the elongated beam 18 of the strut 14 may be a pivotable hinge 24. The elongated beam 18 of the strut 14, the crossbar 22 and the panels 10 to which the elongated beam 18 and the crossbar 22 are connected form a framework 26. The panels 10 are also connected to each other by a connector 28, comprising at least two latches. A ground profile 32 is configured to rest on the ground surface 34. The ground plate 15, the frame 16 of the panels 10 and the ground profile 32 may be provided with a protective cover 33. The panels 10 may be provided with reinforcing bar 35.

Figure 3A:
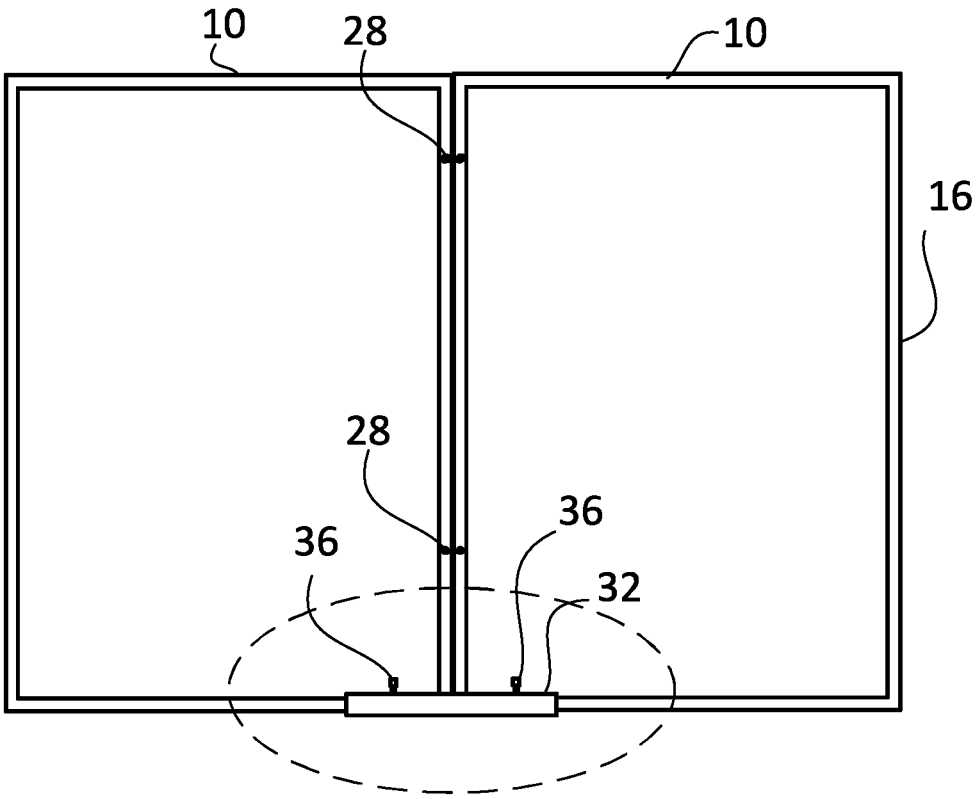
FIGS. 3*a* and 3*b* illustrate schematic front views of connected and disconnected panels according to an example.
Figure 3B:
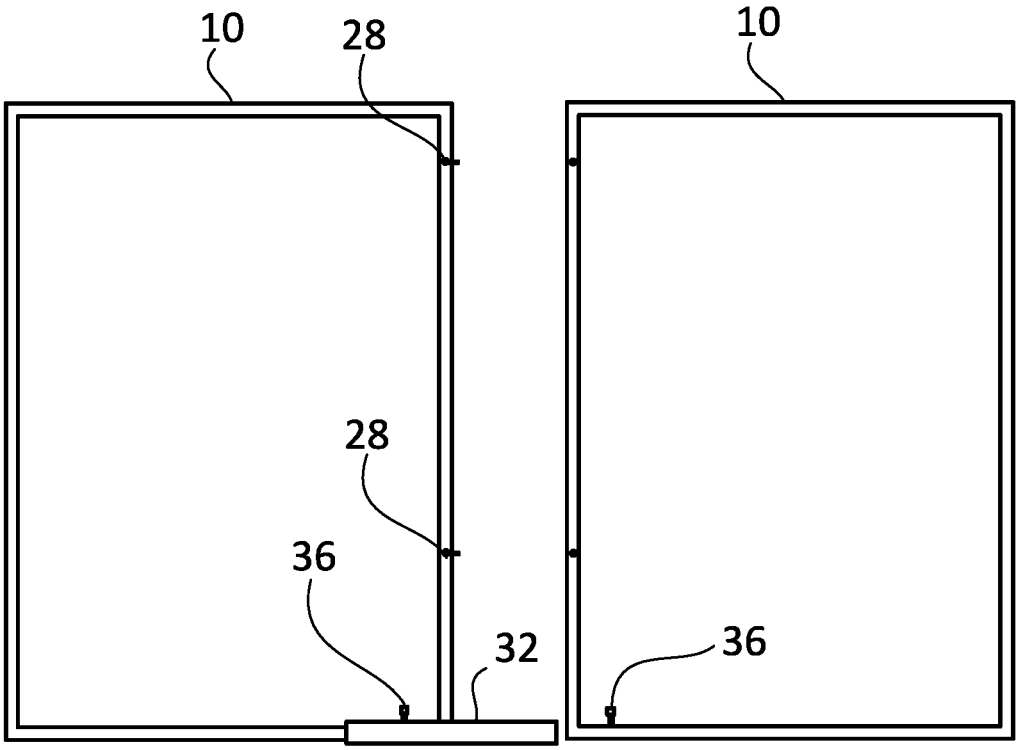

FIGS. 3*a* and 3*b* illustrate schematic front views of connected and disconnected panels 10 according to an example. The ground profile 32 is configured to guide two panels 10 in relation to each other. Adjustment elements 36 are configured to displace the panels 10 in relation to the ground profile 32. In FIG. 3*a* the panels 10 are connected by the connectors 28. In FIG. 3*b* the panels 10 are disconnected. One of the panels 10 are still arranged in the ground profile 32. However, both panels 10 may be disconnected from the ground profile 32.

Figure 4A:
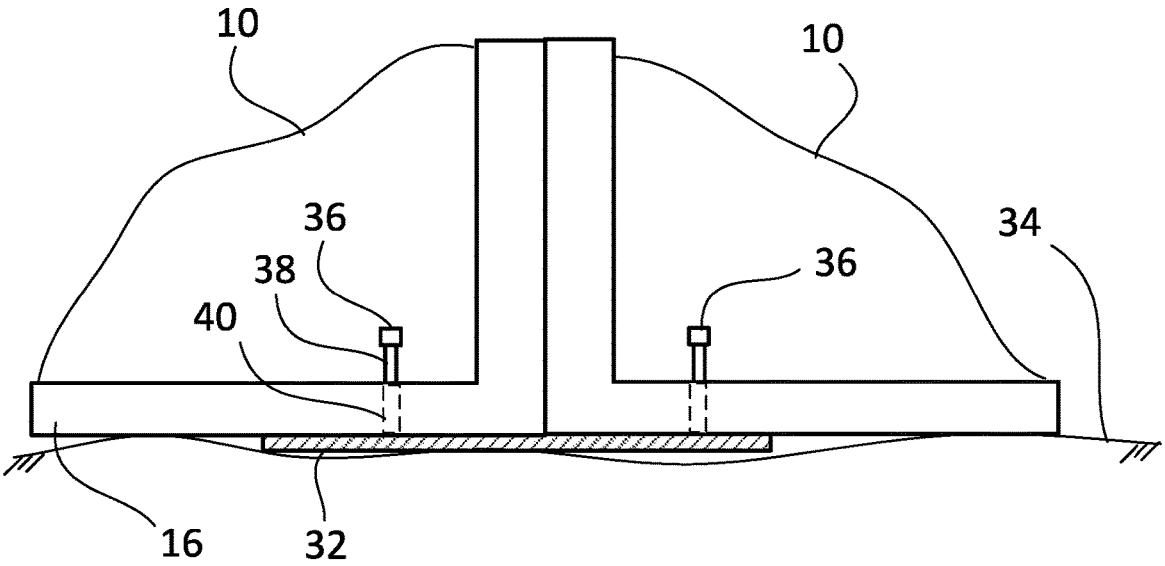
FIGS. 4*a* and 4*b* illustrate detail views of a ground profile and adjustment elements according to an example.
Figure 4B:
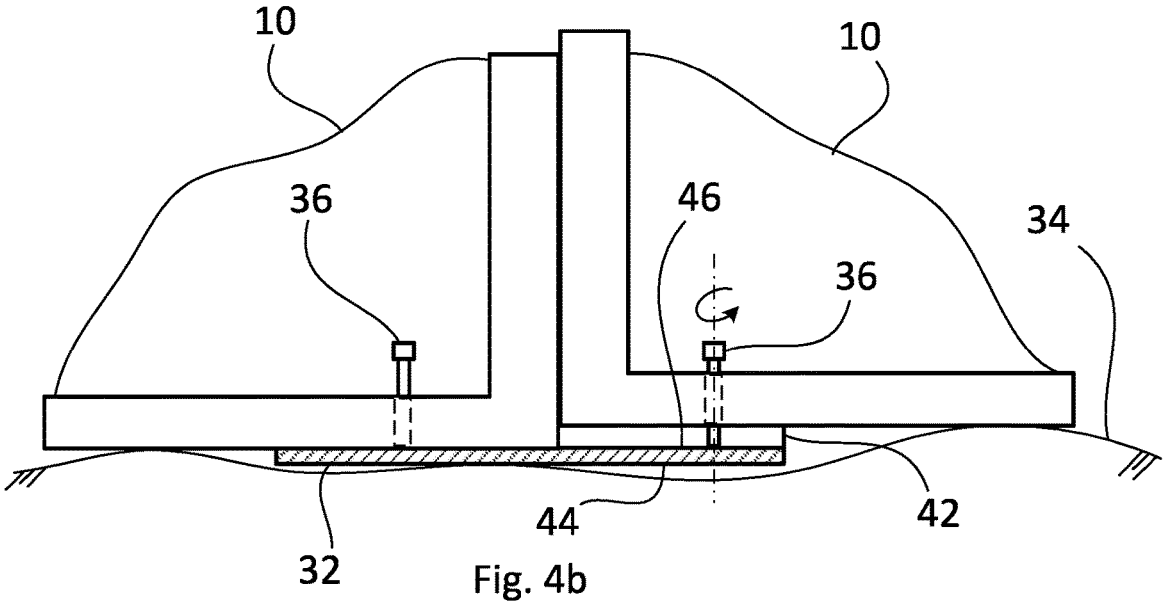

FIGS. 4*a* and 4*b* illustrate detail views of a ground profile 32 and adjustment elements 36 according to an example. The detail views represent the encircled part in FIG. 3*a* of the connected panels 10. The adjustment element 36 is a threaded bolt 38 arranged in a threaded bore 40 in the panel 10. The threaded bore 40 may be arranged in the frame 16. The adjustment element 36 is configured to abut against a surface 46 of the ground profile 32, so that a displacement of the panels 10 in relation to the ground profile 32 is achieved by rotation of the adjustment element 36. The ground profile 32 is a U-beam comprising two flanges 42 connected by a web 44 arranged in a U-profile. The two panels 10 are configured to be arranged within the U-profile of the U-beam and resting on the inner surface 46 of the web of the U-beam. In FIG. 4*a* both panels 10 have the same level. Due to unevenness in the ground surface 34, one of the panels 10 in FIG. 4*b* has been displaced in relation to the ground profile 32 by rotation of the adjustment element 36.

Figure 5B:
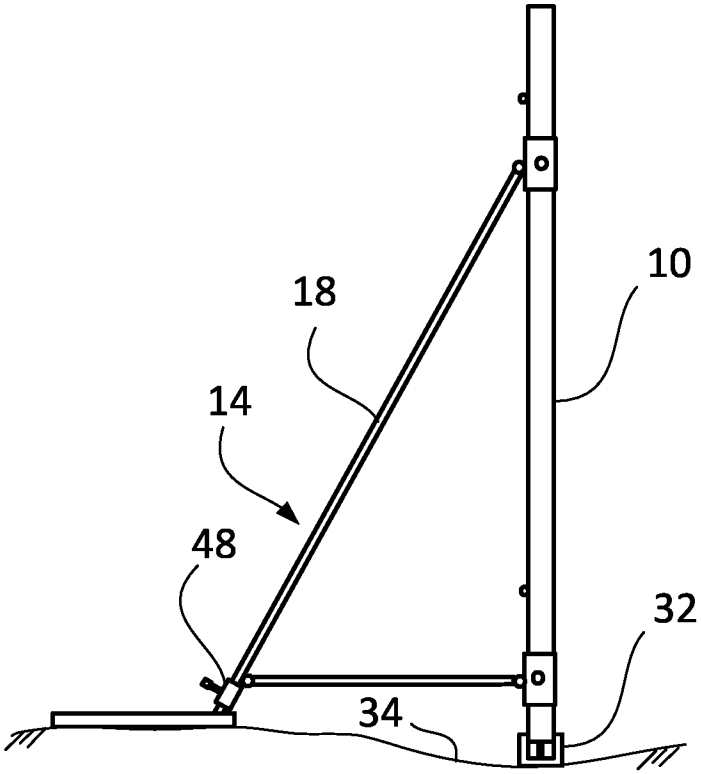
FIGS. 5*a* and 5*b* illustrate a schematic side view of panels connected by a strut according to an example.
Figure 5A:
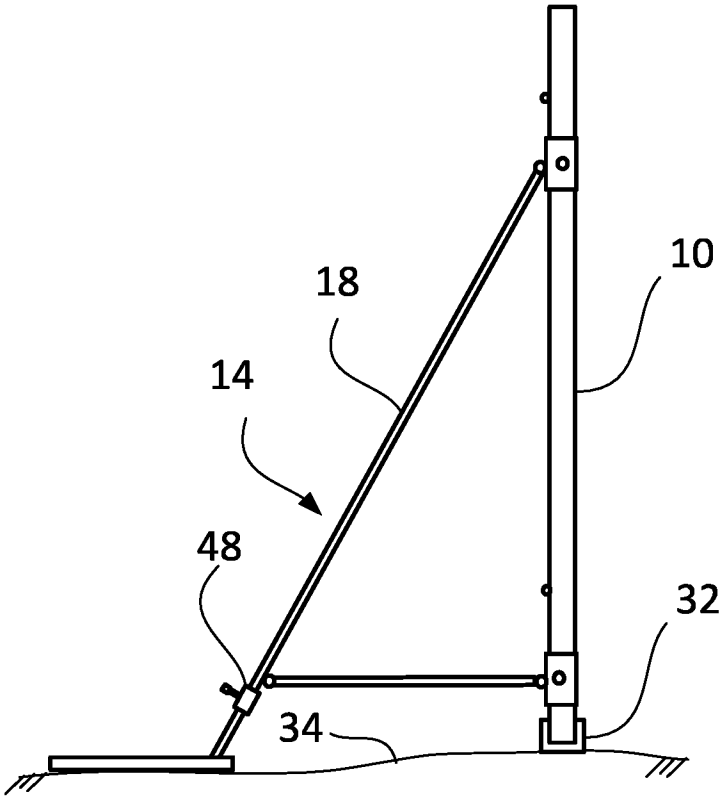

FIGS. 5*a* and 5*b* illustrate a schematic side view of panels 10 connected by a strut 14 according to an example. The strut 14 is extendable by means of a telescopic arrangement 48. The telescopic arrangement 48 is arranged on the elongated beam 18 of the strut 14. In FIG. 5*a* the elongated beam 18 is extended by the telescopic arrangement 48 due to unevenness in the ground surface 34. The panels 10 are not displaced in relation to the ground profile 32. In In FIG. 5*b* the elongated beam 18 is shortened by the telescopic arrangement 48 due to unevenness in the ground surface 34. The panels 10 are displaced in relation to the ground profile 32. Due to this adjustment, the panels 10 may be arranged in a vertical position and still receive stability and support by the strut 14 and the ground profile 32.

Figure 6A:
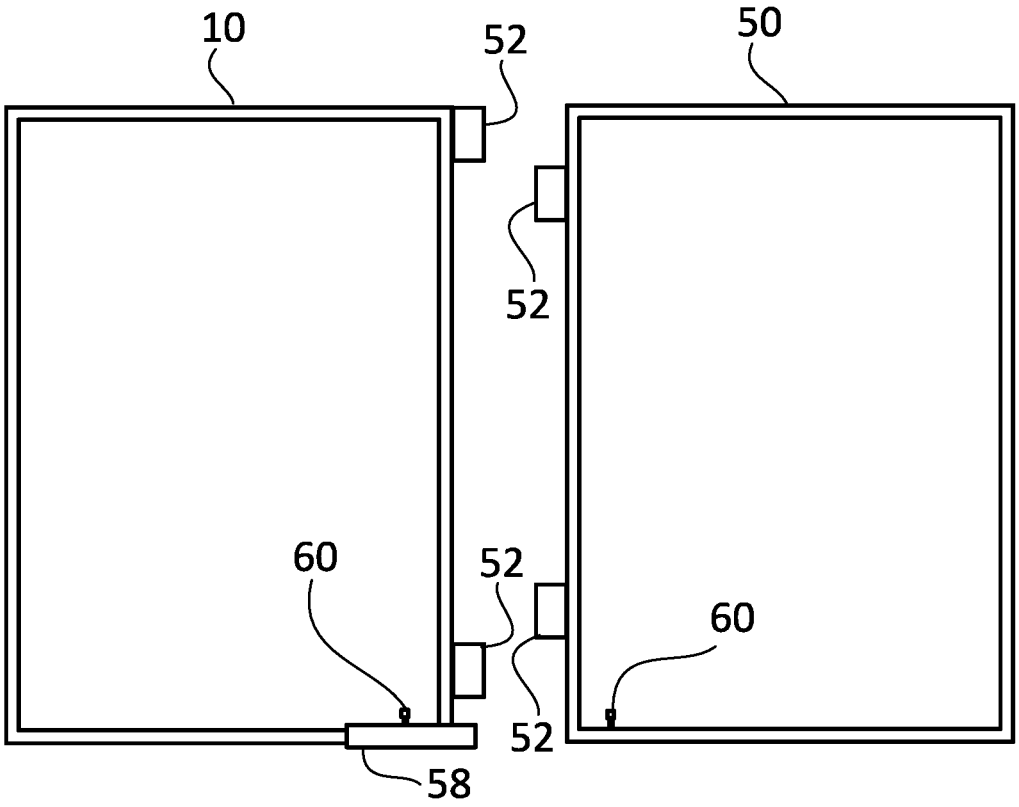
FIGS. 6*a* and 6*b* illustrate schematic views of disconnected and connected panels according to an example.
Figure 6B:
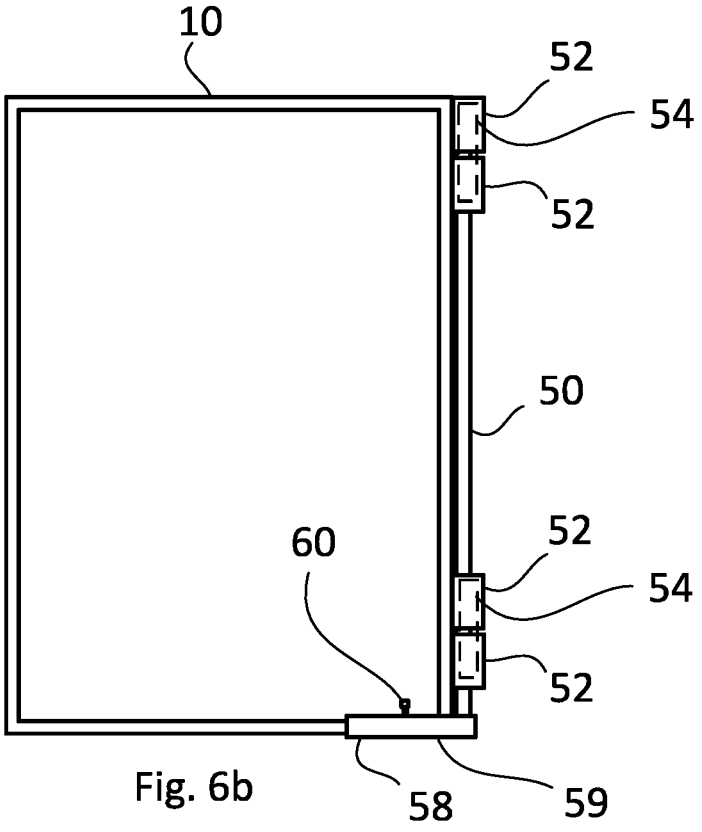

FIGS. 6*a* and 6*b* illustrate schematic views of disconnected and connected panels 10 according to an example. One of the two panels 10 in FIG. 2*a* is configured to be connected to a further panel 50 at a corner of the padel field 2 (FIG. 1). A further ground profile 58 is configured to guide the further panel 50 in relation to the other panel 10. The further panel 50 is configured to be displaceable in relation to the further ground profile 58. The further panel may be connected to one of the connected panels 10 by means of loops 52 arranged on sides of the respective panels 10, 50. In FIG. 6*a* the panels 10 are disconnected and the further panel 50 is arranged in the same plane as the other panel 10 for the sake of clarity. However, in FIG. 6*b* the further panel 50 has been pivoted 90' and is connected to the other panel 10 by a pin 54 passing through the loops 52. The loops 52 and the pin 54 are configured as a catch, locking the panels 10, 50 to each other in order to form a corner.

Figure 6C:
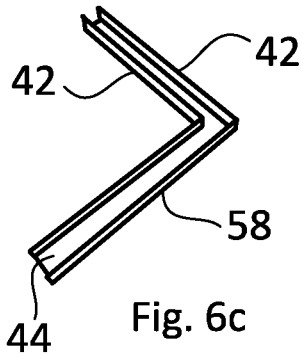
FIG. 6*c* illustrates a schematic view in perspective of a further ground profile according to an example.

FIG. 6*c* illustrates a schematic view in perspective of a further ground profile 58 according to an example. The further ground profile 58 is a corner profile configured to extend in orthogonal directions. The further ground profile 58 may be a U-beam extending in orthogonal directions. The U-beam comprising two flanges 42 connected by a web 44 arranged in a U-profile. An outer surface 59 (FIG. 6*b*) of the web 44 of the U-beam is configured to rest on the ground surface 34. Further adjustment elements 60 (FIG. 6*a* and FIG. 6*b*) may be configured to abut the inner surface 46 of the web of the U-beam, so that a displacement of the further panel 50 in relation to the U-beam is achieved by rotation of the further adjustment element 60.

Figure 7:
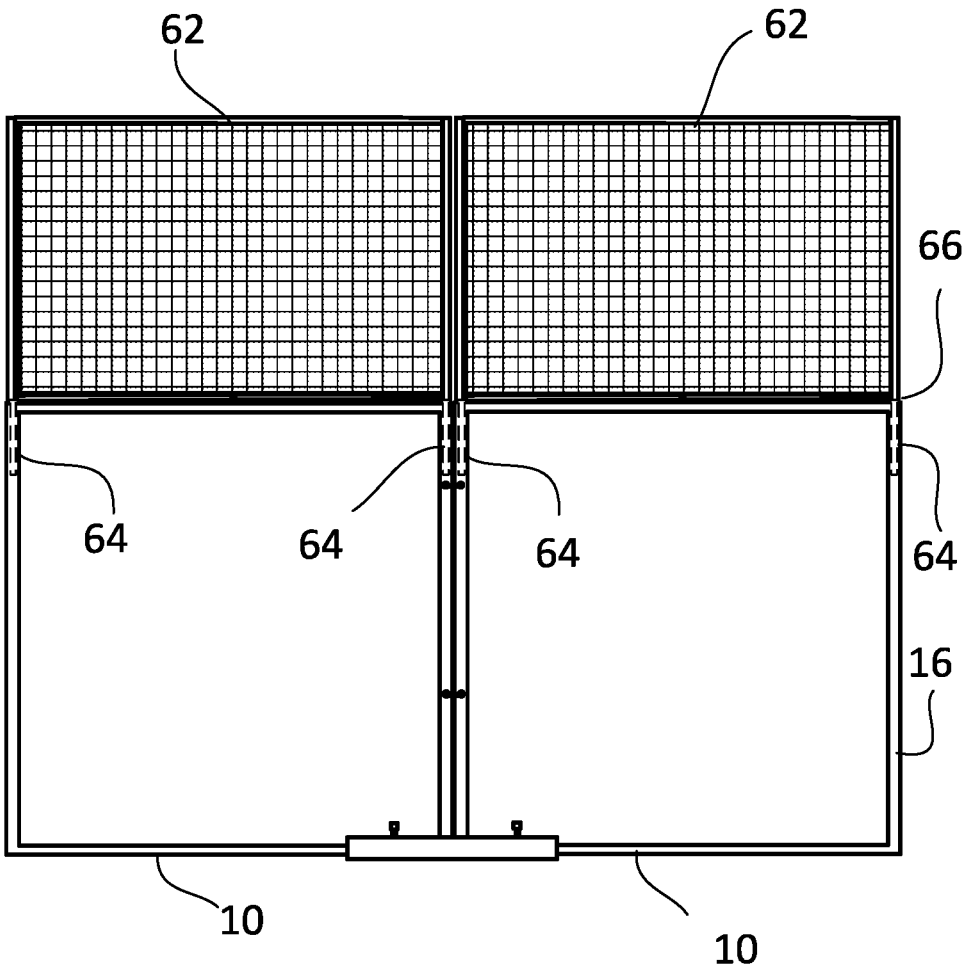
FIG. 7 illustrates a schematic front view of fences connected to a pair of panels according to an example.

FIG. 7 illustrates a schematic front view of fences 62 connected to a pair of panels 10 according to an example. The fences 62 are configured to be connected to the panels 10 by rods 64, which are adapted to be introduced in openings 66 arranged in the top of the frame 16 of the panels 10. The fence 62 may be disconnected from the panels 10 when transporting the padel court construction 1 between different locations. There may be different sizes and shapes of the panels 10. They may be quadratic or rectangular.

Figure 8B:
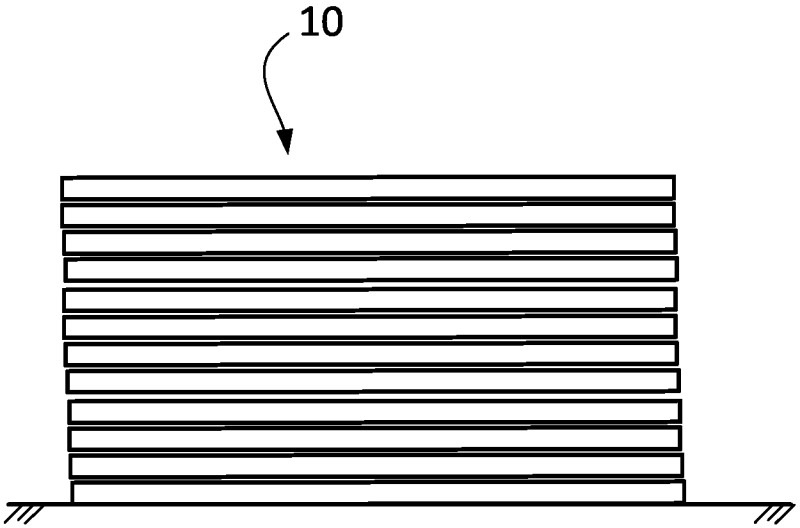
FIGS. 8*a* and 8*b* illustrate schematic side views of disconnected struts and panels stapled for transportation according to an example.
Figure 8A:
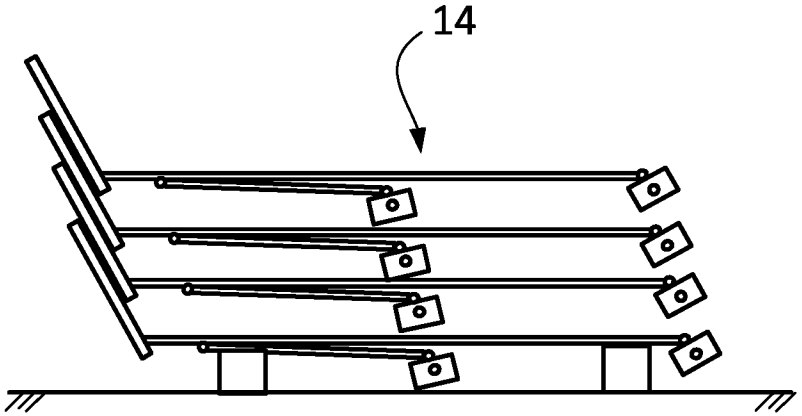

FIGS. 8*a* and 8*b* illustrate schematic side views of disconnected struts 14 and panels 10 stapled for transportation according to an example. The padel court construction 1 is compact when dismantled and takes up a small space for transportation. Thus, a cost effective transportation on trucks or trains may be achieved.

Figure 9:
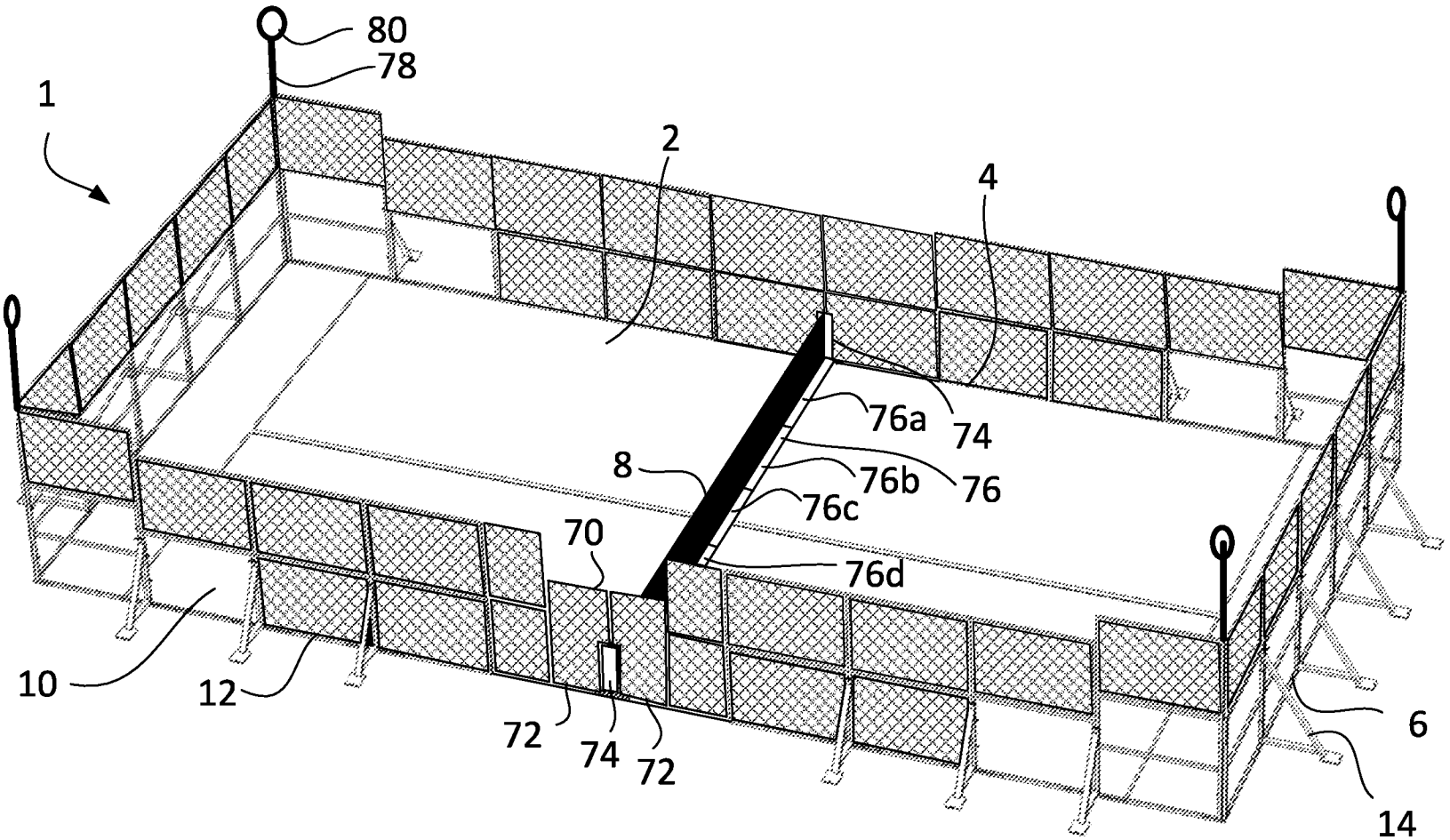
FIG. 9 illustrates a schematic view in perspective of a padel court construction according to an example.

FIG. 9 illustrates a schematic view in perspective of a padel court construction 1 according to an example. According to this example, an entrance system 70 to the padel field 2 is arranged to the panels 10 at one long side 4 of the padel field 2. The entrance system 70 comprising lockable doors 72. A further entrance system 70 (not disclosed) may be arranged also on the other long side 4 of the padel field 2. The net 8 is suspended by a cable (not disclosed) an attached to two lateral posts 74. The net 8 is tensioned between the posts 74. The posts 74 have a flat configuration and end up in level with the surface of the doors 72 of the entrance system 70 when the doors 72 are closed. An elongated beam 76 extends between the posts 74. The elongated beam 76 is releasably connected to the posts 74 and will keep the posts 74 at a fixed distance from each other. The beam 76 may comprise a number of sub-beams 76 *a-d*, which are connectable to and disconnectable from each other. Lightning fixtures 78 are arranged at each corner of the padel field 2. The lightning fixtures 78 comprise LED-lights 80 directed to the padel field 2 in order to illuminate the padel field 2.

Figure 10:
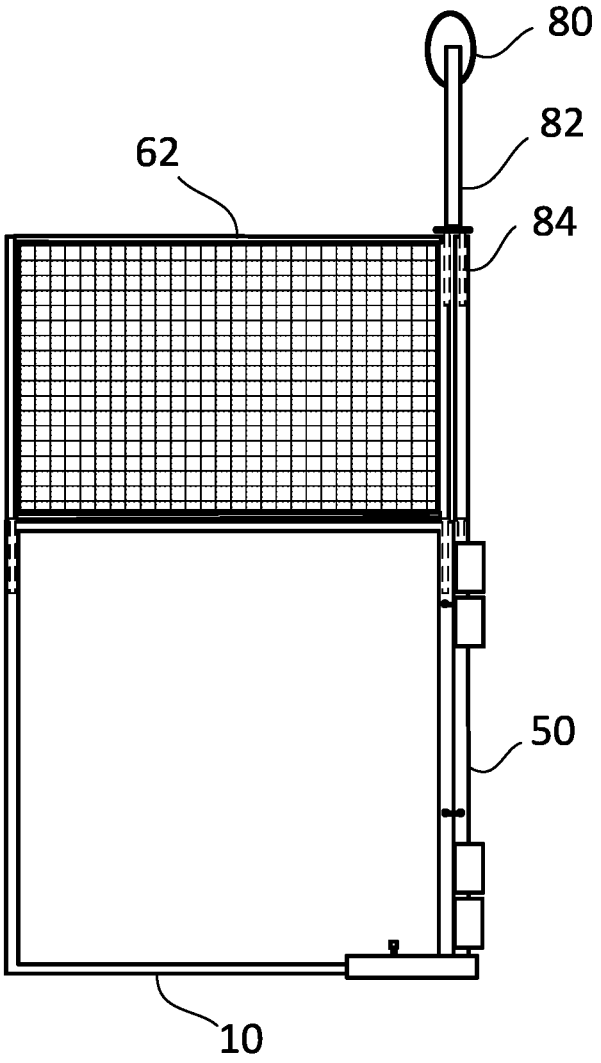
FIG. 10 illustrates a schematic view of a lighting fixture for a padel court construction according to an example.

FIG. 10 illustrates a schematic view of the lighting fixture 78 for the padel court construction 1 according to an example. The lighting fixture 78 comprises stand 82, which in one end is provided with rod members 84 arranged in pairs and configured to be introduced in openings arranged in the top corner of the fences 62 of the corner panels 10, 50. The stand 82 may be disconnectable from the fences 62. In the other end of the stand 82, a LED-light 80 is arranged. The LED-light 80 may be connected to electric power (not disclosed) for illuminating the padel field 2.

Figure 11:
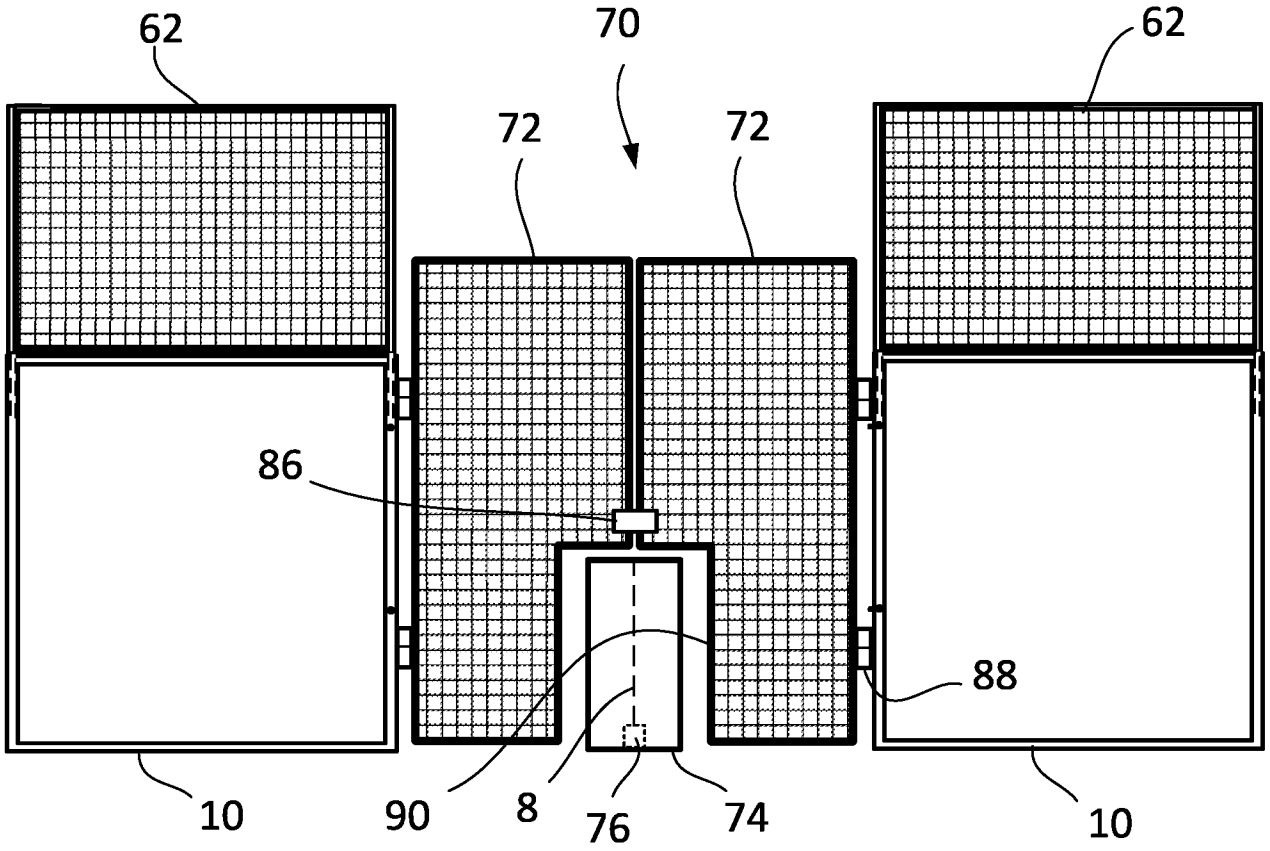
FIG. 11 illustrates a schematic view of an entrance system for a padel court construction according to an example.

FIG. 11 illustrates a schematic view of the entrance system 70 for the padel court construction 1 according to an example. The lockable doors 72 of the entrance system 70 comprise a lock 86. The lockable doors 72 are pivotable connected to the panels 10 by means of hinges 88. The lockable doors 72 may be disconnected from the panels 10 when unlocked. The lockable doors 72 are designed with a cut away 90 for the post 74. When the doors 72 are closed, the post 74 end up in level with the surface of the lockable doors 72, and thus at least partly fill up the space formed by the cut away 90 of the lockable doors 72. In FIG. 11, the net 8 and the elongated beam 76, which extends between the posts 74 are disclosed with broken lines.

The foregoing description of the embodiments has been furnished for illustrative and descriptive purposes. It is not intended to be exhaustive, or to limit the embodiments to the variations described. Many modifications and variations will obviously be apparent to one skilled in the art. The embodiments have been chosen and described in order to best explicate principles and practical applications, and to thereby enable one skilled in the arts to understand the invention in terms of its various embodiments and with the various modifications that are applicable to its intended use. The components and features specified above may, within the framework of the disclosure, be combined between different embodiments specified.

The invention claimed is:

1. A padel court construction for playing padel, the padel court construction comprising:

a padel field;

at least two panels configured to at least partly enclose the padel field; and at least one strut configured to connect the at least two panels to each other, wherein the padel court construction further comprising:

a ground profile configured to guide the at least two panels in relation to each other, wherein the ground profile is a U-beam comprising two flanges connected by a web arranged in a U-profile; and an adjustment element configured to displace at least one of the panels in relation to the ground profile.

2. The padel court construction according to claim 1, wherein the adjustment element is a threaded bolt arranged in a threaded bore in the at least one panel.

3. The padel court construction according to claim 2, wherein the adjustment element is configured to abut against a surface of the ground profile, so that a displacement of the at least one panel in relation to the ground profile is achieved by rotation of the adjustment element.

4. The padel court construction according to claim 1, wherein the at least two panels are configured to be arranged within the U-profile of the U-beam and resting on an inner surface of the web of the U-beam.

5. The padel court construction according to claim 1, wherein the at least one strut comprises a crossbar, which is configured to connect the at least two panels to each other.

6. The padel court construction according to claim 5, wherein the strut and panels together are configured as a framework.

7. The padel court construction (1) according to claim 1, wherein the at least one strut is extendable by means of a telescopic arrangement.

8. The padel court construction according to claim 1, wherein a fence is configured to be connected to at least one of the panels by rods, which are adapted to be introduced in openings arranged in a top of the at least one panel.

9. The padel court construction according to claim 1, wherein the at least two panels are configured to be connected to a further panel at a corner of the padel field, and wherein a further ground profile is configured to guide the further panel in relation to one of the at least two panels; and wherein the further panel is configured to be displaceable in relation to the further ground profile.

* * * * *